United States Patent [19]

Koester et al.

[11] Patent Number: 4,790,931

[45] Date of Patent: Dec. 13, 1988

[54] SURFACTANT MIXTURES AS COLLECTORS FOR THE FLOTATION OF NON-SULFIDIC ORES

[75] Inventors: Rita Koester; Wolfgang von Rybinski, both of Duesseldorf, Fed. Rep. of Germany

[73] Assignee: Henkel Kommanditgesellschaft auf Aktien, Duesseldorf, Fed. Rep. of Germany

[21] Appl. No.: 127,749

[22] Filed: Dec. 2, 1987

[30] Foreign Application Priority Data

Dec. 4, 1986 [DE] Fed. Rep. of Germany ..... 3641447

[51] Int. Cl.[4] ..... B03D 1/02

[52] U.S. Cl. ..... 209/166; 252/61; 252/DIG. 1

[58] Field of Search ..... 209/166, 167; 252/61, 252/DIG. 1, 559; 75/2

[56] References Cited

U.S. PATENT DOCUMENTS

| | | | |
|---|---|---|---|
| 3,865,718 | 2/1975 | Tueter | 209/166 |
| 4,138,350 | 2/1979 | Wang | 209/166 |
| 4,233,150 | 11/1980 | Wang | 209/166 |
| 4,252,540 | 2/1981 | Yamamura | 252/DIG. 1 |
| 4,309,282 | 1/1982 | Smith | 209/166 |
| 4,330,398 | 3/1982 | Alford | 209/166 |
| 4,364,777 | 12/1982 | Grünert | 252/DIG. 1 |
| 4,532,031 | 7/1985 | Wang | 209/166 |
| 4,548,729 | 10/1985 | Schmid | 252/174.21 |
| 4,564,463 | 1/1986 | Secenski | 252/DIG. 1 |
| 4,565,647 | 1/1986 | Uenado | 209/166 |

FOREIGN PATENT DOCUMENTS

| | | | |
|---|---|---|---|
| 3517154 | 11/1986 | Fed. Rep. of Germany | 209/166 |
| 782107 | 9/1957 | United Kingdom | 209/166 |

OTHER PUBLICATIONS

Trans. Inst. Met. Min. Sect. C84 (1975), A. Doren, D. Vargas, J. Goldfarb, pp. 34–37.

Dev. Min. Proc. 2 (1979), A. Doren, A. van Lierde and J. A. de Cuyper, pp. 86–109.

A. M. Gaudin Memorial Volume (1976), vol. 1, Ed., M. C. Furstenau, AIME, pp. 597–620.

*Primary Examiner*—Kenneth M. Schor

*Assistant Examiner*—Thomas M. Lithgow

*Attorney, Agent, or Firm*—Ernest G. Szoke; Henry E. Millson, Jr.; Wayne C. Jaeschke

[57] ABSTRACT

Mixtures of (a) at least one alkyl or alkenyl polyethylene glycol ether which is terminally blocked by a hydrophobic radical, and (b) at least one anion-active surfactant are used as collectors in the flotation of non-sulfide ores.

16 Claims, No Drawings

SURFACTANT MIXTURES AS COLLECTORS FOR THE FLOTATION OF NON-SULFIDIC ORES

BACKGROUND OF THE INVENTION

1. Field of the Invention

This invention relates to the use of terminally blocked alkyl polyethyleneglycol ethers as co-collectors in the flotation of non-sulfidic ores together with anion-active surfactant components, and to a process for the separation of non-sulfidic ores by flotation.

2. Statement of Related Art

Flotation is a separation technique commonly used in the dressing of mineral ores for separating valuable minerals from the gangue. Non-sulfidic minerals in the context of the present invention are, for example, apatite, fluorite, scheelite, baryta, iron oxides and other metal oxides, for example the oxides of titanium and zirconium, and also certain silicates and aluminosilicates. In dressing processes based on flotation, the ore is normally first subjected to preliminary size-reduction, dry-ground, but preferably wet-ground, and suspended in water. Collectors or collector mixtures are then normally added, often in conjunction with frothers and, optionally, other auxiliary reagents such as regulators, depressors (deactivators) and/or activators, in order to facilitate separation of the valuable minerals from the unwanted gangue constituents of the ore in the subsequent flotation process. These reagents are normally allowed to act on the finely ground ore for a certain time (conditioning) before air is blown into the suspension (flotation) to produce a froth at its surface. The collector acts as a hydrophobicizing agent on the surface of the minerals causing the minerals to adhere to the gas bubbles formed during the aeration step. The mineral constituents are selectively hydrophobicized so that the unwanted consituents of the ore do not adhere to the gas bubbles. The mineral-containing froth is stripped off and further processed. The object of flotation is to recover the valuable material of the ores in as high a yield as possible while at the same time obtaining a high enrichment level of the valuable mineral.

Surfactants and, in particular, anionic and cationic surfactants are used in the flotation-based dressing of ores. Known anionic collectors are, for example, saturated or unsaturated fatty acids, alkyl sulfates, alkylether sulfates, alkyl sulfosuccinates, alkyl sulfosuccinamides, alkyl benzene sulfonates, alkyl sulfonates, petroleum sulfonates, acyl lactylates, alkyl phosphates, and alkyl ether phosphates.

In contrast to anionic and cationic surfactants, nonionic surfactants are hardly ever used as collectors in flotation. In Trans. Inst. Met. Min. Sect. C 84 (1975), pages 34 to 39, A. Doren, D. Vargas and J. Goldfarb report on flotation tests on quartz, cassiterite and chrysocolla which were carried out with an adduct of 9 to 10 moles ethylene oxide with octylphenol as collector. Combinations of ionic and nonionic surfactants are also occasionally described as collectors in the relevant literature. Thus, A. Doren, A. van Lierde and J. A. de Cuyper report in Dev. Min. Proc. 2 (1979), pp. 86–109 on flotation tests carried out on a non-sulfidic tin ore with a combination of an adduct of 9 to 10 moles ethylene oxide with octylphenol and an octadecyl sulfosuccinate. In A. M. Gaudin Memorial Volume, edited by M. C. Fuerstenau, AIME, New York, 1976, Vol. 1, pp. 597–620, V. M. Lovell describes flotation tests carried out on an apatite with a combination of tall oil fatty acid and nonylphenol tetraglycol ether.

Published German patent application No. 35 17 154.5 (U.S. pending application Ser. No. 861,672, filed May 11, 1985) proposes the use of nonionic ethylene oxide/-propylene oxide adducts in addition to anionic, cationic or ampholytic surfactants as aids in the flotation of non-sulfidic ores.

In many instances, the anionic and ampholytic collectors used for flotation do not lead to satisfactory recovery of the valuable minerals when used in economically reasonable quantities.

DESCRIPTION OF THE INVENTION

Other than in the operating examples, or where otherwise indicated, all numbers expressing quantities of ingredients or reaction conditions used herein are to be understood as modified in all instances by the term "about".

An object of the present invention is to find improved collectors which make flotation processes more economical, i.e. with which it is possible to obtain either greater yields of valuable minerals for the same quantities of collector and for the same selectivity, or at least the same yields of valuable materials for reduced quantities of collector.

It has been found that certain terminally blocked alkyl or alkenyl polyethylene glycol ethers represent highly effective additions as co-collectors to anion-active surfactants of the type known as collectors for the flotation of non-sulfidic ores.

The present invention relates to the use of mixtures of (a) at least one alkyl or alkenyl polyethylene glycol ether which is terminally blocked by a hydrophobic radical, and (b) at leaast one anion-active surfactant as collectors in the flotation of nonsulfidic ores.

Alkyl polyethylene glycol ethers of formula 1

$$R^1—O—(CH_2CH_2O)_n—R^2 \quad (1)$$

wherein $R^1$ represents a straight-chain or branched alkyl or alkenyl radical having 8 to 22 carbon atoms, $R^2$ represents a straight-chain or branched alkyl radical having 1 to 8 carbon atoms or a benzyl radical and n represents a number from 1 to 30 are contemplated in particular as component (a).

The terminally blocked alkyl polyethylene glycol ethers set forth above constitute a class of compounds which is known from the literature; they may be obtained in accordance with known methods of organic synthesis (see, for example, U.S. Pat. No. 2,856,434, U.S. Pat. Nos. 3,281,475, 4,366,326, European patent application No. 0,030,397 and U.S. Pat. No. 4,548,729). These terminally blocked alkyl or alkenyl polyethylene glycol ethers are chemically more resistant than the corresponding alkyl or alkenyl polyethylene glycol ethers containing a free terminal hydroxyl group. Since terminally blocked alkyl or alkenyl polyethylene glycol ethers foam less than their precursors in aqueous solution, they also are useful for (alkaline) cleaning processes involving heavy mechanical stressing.

Known fatty alcohols may be used as starting materials for the terminally blocked alkyl or alkenyl polyethylene glycol ethers. The fatty alcohol component may consist of straight-chain and branched, saturated and unsaturated compounds of this category containing from 8 to 22 carbon atoms, for example, n-octanol, n-decanol, n-dodecanol, n-tetradecanol, n-hexadecanol, n-octadecanol, n-eicosanol, n-docosanol, n-hexadecenol, isotridecanol, isooctadecanol and n-octadecanol. The above fatty alcohols may individually form the basis of the terminally blocked alkyl and alkenyl polyethylene glycol ethers. However, products based on fatty alcohol mixtures are generally used, the fatty alcohol mixtures emanating from the fatty acid component of fats and oils of animal or vegetable origin. Fatty alcohol mixtures such as these may be obtained in known manner from the naturally occurring fats and oils, inter alia, by transesterification of the triglycerides with methanol and subsequent catalytic hydrogenation of the fatty acid methyl ester. In this case, both the fatty alcohol mixtures accumulating during production and also suitable fractions having a limited chain length spectrum may be used as basis for the production of the terminally blocked alkyl or alkenyl polyethylene glycol ethers. In addition to the fatty alcohol mixtures obtained from natural fats and oils, it is also possible to use synthetic fatty alcohol mixtures, for example the known Ziegler and oxo fatty alchols, as starting materials for the production process.

Terminally blocked alkyl polyethylene glycol ethers based on fatty alcohols having 12 to 18 carbon atoms, that is, compounds of formula 1 wherein $R^1$ represents an alkyl or alkenyl radical having 12 to 18 carbon atoms are preferred components (a) in the surfactant mixtures to be used in accordance with the invention.

To produce the terminally blocked alkyl and alkenyl polyethylene glycol ethers, the fatty alcohols described above are preferably first reacted with 1 to 30 moles, preferably 2 to 15 moles of ethylene oxide per mole of fatty alcohol. The reaction with ethylene oxide is carried out under the known alkoxylation conditions, preferably in the presence of suitable alkaline catalysts.

The etherification of the free hydroxyl groups, necessary for the terminal blocking of the alkyl or alkenyl polyethylene glycol ethers, can be carried out in accordance with methods known from the literature (see, for example, U.S. Pat. No. 2,856,434, U.S. Pat. No. 3,281,475, and U.S. Pat. No. 4,366,326, European patent application 0,030,397 and U.S. Pat. No. 4,548,729). The etherification of the free hydroxyl groups is preferably carried out under the known conditions of Williamson's ether synthesis using linear or branched $C_1$–$C_8$-alkyl halides, for example n-propyl iodide, n-butyl chloride, sec.-butyl bromide, tert.-butyl chloride, n-amyl chloride, ter.-amyl bromide, n-hexyl chloride, n-heptyl bromide, n-octyl chloride, and benzyl chloride. In this connection, it may be expedient to use the alkyl halide and alkali, such as an alkali metal hydroxide, in a stoichiometric excess, for example of from 100% to 200%, over the hydroxyl groups to be etherified. A suitable method is disclosed in U.S. Pat. No. 4,548,729. In a preferred embodiment of the invention, alkyl polyethylene glycol ethers which are terminally blocked by n-butyl radicals are used as component (a) in the surfactant mixtures of the invention.

The anion-active surfactants contemplated as component (b) in the surfactant mixtures to be used in accordance with the invention are of the type known per se as collectors for the flotation of non-sulfidic ores. They are, in particular, anion-active surfactants selected from fatty acids, alkyl sulfates, alkyl ether sulfates, alkyl sulfosuccinates, alkyl sulfosuccinamides, alkyl benzene sulfonates, alkyl sulfonates, petroleum sulfonates, acyl lactylates, alkyl phosphates and alkyl ether phosphates.

Suitable fatty acids include the straight-chain fatty acids containing from 12 to 18 carbon atoms and more especially from 16 to 18 carbon atoms obtained from vegetable or animal fats and oils, for example by lipolysis and, optionally, fractionation and/or separation by the hydrophilization process. Oleic acid and tall oil fatty acid are preferred.

Suitable alkyl sulfates include the water-soluble salts of sulfuric acid semiesters of fatty alcohols having 8 to 22 carbon atoms and preferably of fatty alcohols having 12 to 18 carbon atoms which may be linear or branched. The foregoing discussions of the fatty alcohol component of the alkyl or alkenyl polyethylene glycol ethers to be used as component (a) also apply to the fatty alcohol component of the sulfuric acid semiesters. The water-soluble salts are preferably the alkali metal salts, more preferably the sodium salts.

Suitable alkyl ether sulfates include the water-soluble salts of sulfuric acid semiesters of reaction products of 1 to 30 moles of ethylene oxide, preferably 2 to 15 mole ethylene oxide and fatty alcohols having 8 to 22 carbon atoms, preferably 12 to 18 carbon atoms. The foregoing discussions of the fatty alcohol component of the alkyl or alkenyl polyethylene glycol ethers to be used as component (a) also apply to the fatty alcohol component of these sulfuric acid semiesters. The water-soluble salts are preferably the alkali metal salts or ammonium salts, more preferably the sodium and ammonium salts.

Suitable alkyl sulfosuccinates include the water-soluble salts of sulfosuccinic acid semiesters of fatty alcohols having 8 to 22 carbon atoms and preferably of fatty alcohols having 12 to 18 carbon atoms. These alkyl sulfosuccinates may be obtained, for example, by reaction of corresponding fatty alcohols or fatty alcohol mixtures with maleic acid anhydride and subsequent addition of alkali metal sulfite or alkali metal hydrogen sulfite. The foregoing discussions of the fatty alcohol component of the alkyl or alkenyl polyethylene glycol ethers to be used as component (a) also apply to the fatty alcohol component of the sulfosuccinic acid esters. The water-soluble salts are preferably the alkali metal salts, more preferably the sodium salts.

The alkyl sulfosuccinamides which can be employed as component (b) correspond to the following formula

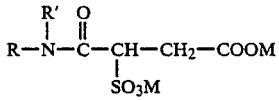

(II)

in which R is an alkyl or alkenyl group containing from 8 to 22 carbon atoms and preferably from 12 to 18 carbon atoms, R′ represents hydrogen or a $C_1$–$C_3$ alkyl group and M is a hydrogen ion, an alkali metal cation, for example sodium, potassium, lithium etc., or an ammonium ion, preferably a sodium or ammonium ion. The alkyl sulfosuccinamides corresponding to formula II are known substances obtained, for example, by reaction of corresponding primary or secondary amines with maleic acid anhydride and subsequent addition of alkali metal sulfite or alkali metal hydrogen sulfite. Examples of primary amines suitable for use in the preparation of the alkyl sulfosuccinamides are n-octyl amine, n-decyl amine, n-dodecyl amine, n-tetradecyl amine, n-hexadecyl amine, n-octadexyl amine, n-eicosyl amine, n-docosyl amine, n-hexadecenyl amine and n-octadecenyl amine. The above amines can individually form the basis of the alkyl sulfosuccinamides. However, amine mixtures of which the alkyl groups are derived from the fatty acid component of fats and oils of animal or vegetable origin are normally used for preparing the alkyl sulfosuccinamides. It is known that amine mixtures such as these can be obtained from the fatty acids of naturally occurring fats and oils obtained by lipolysis via the corresponding nitriles by reduction with sodium and alcohols or by catalytic hydrogenation. Secondary amines suitable for use in the preparation of the alkyl sulfosuccinamides corresponding to formula II include the N-methyl and N-ethyl derivatives of the primary amines disclosed above.

Alkyl benzene sulfonates suitable for use as component (b) correspond to the following formula $$R—C_6H_4—SO_3M \quad \text{(III)}$$

in which R is a straight-chain or branched alkyl group containing from 4 to 16 and preferably from 8 to 12 carbon atoms and M is an alkali metal cation, e.g. sodium, potassium, lithium etc., or ammonium ion, preferably a sodium ion.

Alkyl sulfonates suitable for use as component (b) correspond to the following formula $$R—SO_3M \quad \text{(IV)}$$

in which R is a straight-chain or branched alkyl group preferably containing 8 to 22 carbon atoms, and more preferably, from 12 to 18 carbon atoms, and M is an alkali metal cation, e.g. sodium, potassium, lithium etc., or an ammonium ion, preferably a sodium ion.

The petroleum sulfonates suitable for use as component (b) are obtained from lubricating oil fractions, generally by sulfonation with sulfur trioxide or oleum and subsequent neutralization. Those compounds in which most of the hydrocarbon radicals contain from 8 to 22 carbon atoms are particularly suitable.

The alkyl lactylates suitable for use as component (b) correspond to the following formula $$R—\underset{\underset{O}{\|}}{C}—O—\underset{\underset{CH_3}{|}}{CH}—COOX \quad \text{(V)}$$

in which R is an aliphatic, cycloaliphatic or alicyclic radical containing from 7 to 23 carbon atoms and X is a salt-forming cation, e.g. an alkali metal cation or an ammonium ion, R is preferably an aliphatic, linear or branched chain hydrocarbon radical which may be saturated, and optionally substituted by one or more hydroxyl groups. The use of the acyl lactylates corresponding to formula V as collectors in the flotation of nonsulfidic ores is described in U.S. Pat. No. 4,457,850.

Alkyl phosphates and alkyl ether phosphates that can be employed herein correspond to the following formulas:

$$\begin{array}{l} R—(OCH_2CH_2)_m—O \\ \qquad\qquad\qquad\qquad P \\ R—(OCH_2CH_2)_n—O \end{array} \begin{array}{l} O \\ \\ OM \end{array} \quad \text{(VI)}$$

and

-continued $$\begin{array}{l} R—(OCH_2CH_2)_q—O \\ \qquad\qquad\qquad\qquad P \\ MO \end{array} \begin{array}{l} O \\ \\ OM \end{array} \quad \text{(VII)}$$

in which R represents an alkyl or alkenyl residue having from 8 to 22 carbon atoms and M represents hydrogen, an alkali metal, or ammonium, preferably sodium or ammonium. The subscripts m, n and q in the case of the alkyl phosphates are equal to zero; in the case of the alkyl ether phosphates each represents a number of from 2 to 15. The compounds of formulas VI and VII are known substances, which can be synthesized according to known methods. Suitable starting materials for the production of the alkyl phosphates include $C_8$–$C_{22}$ straight chain or branched alcohols having about 8 to 22 carbon atoms described above in connection with the alkyl sulfates and sulfuric acid half esters. Alkyl phosphates in which R has about 10 to 16 carbon atoms are preferably preferred. Starting materials for the production of the alkyl ether phosphates include addition products of 2 to 15 moles ethylene oxide with the above described alcohols containing 8 to 22 carbon atoms. These addition products can be synthesized according to known methods. In the case of the alkyl ether phosphates, compounds of formulas VI and VII, in which R contains about 18 to 22 carbon atoms, are preferred.

In the mixtures of terminally blocked alkyl polyethylene glycol ethers and anion-active surfactant to be used in accordance with the invention, the weight ratio of the components (a):(b) is in the range of from 1:20 to 3:1 and preferably in the range of from 1:10 to 1:1.

In practice, the collector mixtures used in accordance with the invention replace the known collectors in known flotation processes for non-sulfidic ores. Accordingly, other reagents commonly used, such as frothers, regulators, activators, deactivators, etc., are also advantageously added to the aqueous suspensions of the ground ores in addition to the collector mixtures. Flotation is carried out under the same conditions as state-of-the-art processes. In this connection, reference is made to the following literature references on technological background of ore preparation: A. Schubert, Aufbereitung fester mineralischer Rohstoffe, Leipzig 1967; B. Wills, Mineral Processing Technology, New York, 1978; D. B. Purchas (ed.) Solid/Liquid Separation Equipment Scale-Up, Croydon 1977; E. S. Perry, C. J. van Oss, E. Grushka (ed.), Separation and Purification Methods, New York, 1973–1978.

The present invention also relates to a process for the separation of non-sulfidic ores by flotation, in which crushed ore is mixed with water to form a suspension, air is introduced into the suspension in the presence of the collector system of the invention and the froth formed is stripped off together with the mineral therein. To obtain economically useful results for the flotation process, the collector mixtures of the invention are used in quantities of from 50 to 2000 g per metric ton of crude ore, preferably in quantities of from 100 to 1500 g per metric ton of crude ore, in the flotation of nonsulfidic ores.

The collector mixtures of the invention are used with particular advantage in the dressing of ores such as scheelite, baryta, apatite, or iron ores.

The following Examples, given for illustration purposes only, demonstrate the superiority of the mixtures of terminally blocked alkyl or alkenyl polyethyleneglycol ethers and anion active surfactants used in accordance with the invention over collectors known from the prior art.

The tests were carried out under laboratory conditions in some cases with increased collector concentrations considerably higher than necessary in practice. Accordingly, the potential applications and in-use conditions are not limited to the separation, objectives and test conditions described in the Examples. All percentages are percentages by weight, unless otherwise indicated. The quantities indicated for reagents are all based on active substance.

EXAMPLES

Example 1

The material to be floated was a scheelite ore from Austria which had the following chemical composition with respect to its principal constituents:

| | |
|---|---|
| $WO_3$ | 0.3% |
| CaO | 8.8% |
| $SiO_2$ | 55.8% |

The ore had the following particle size distribution:

| | |
|---|---|
| 28% | <25 μm |
| 43% | 25-100 μm |
| 29% | 100-200 μm |

The collector mixture used contained the sodium salt of an N-$C_{12-8}$-alkylsulfosuccinamide as the anion-active component (b). A fatty alcohol polyethylene glycol n-butylether based on an adduct of 7 moles ethylene oxide with one mole of a fatty alcohol mixture having a chain length of from 12 to 18 carbon atoms was used as the nonionic component (a) according to the invention. The weight ratio of component (b) to component (a) was 2:1.

The flotation tests were carried out in a 1 liter flotation cell using a Humbold-Wedag laboratory flotation machine of the type manufactured by KHD Industrieanlagen AG, Humbold-Wedag, Cologne (see Seifen-Fette-Wachse 105 (1979), page 248). Deionized water was used to prepare the pulp. The pulp density was 400 g/l. Waterglass was used as depressor in a quantity of 2000 g per metric ton. The conditioning time of the depressor was 10 minutes at a stirring speed of 2000 rpm. Flotation was carried out at the pH value of approx. 9.5 obtained by addition of the waterglass. The collector dosage is shown in Table 1 below. The conditioning time of the collector was 3 minutes. The results obtained are shown in Table 1.

Comparison Example 1

A flotation test was carried out in accordance with Example 1 using the alkyl sulfosuccinamide of Example 1 alone as collector. The results obtained are shown in Table 1.

Comparison Example 2

A flotation test was carried out in accordance with Example 1 using a collector mixture of the alkyl sulfosuccinamide of Example 1 and an adduct of 2 moles ethylene oxide and 4 moles propylene oxide with 1 mole of a fatty alcohol having a chain length of from 12 to 18 carbon atoms in a weight ratio of 2:1.

The flotation results are shown in Table 1.

TABLE 1

| | Flotation of scheelite | | | | | |
|---|---|---|---|---|---|---|
| | Total | Recovery | | | | |
| | dosage | Total | $WO_3$ | Concentrate content (%) | | |
| Example | (g/t) | (%) | (%) | $WO_3$ | CaO | $SiO_2$ |
| Comparison Example 1 | 500 | 0.6 | 19 | 10.6 | 8.6 | 34.8 |
| Comparison Example 2 | 300 | 2.5 | 65 | 8.7 | 26.6 | 22.3 |
| | 100 | 0.8 | 5 | 2.4 | 16.3 | 35.8 |
| | Σ400 | 3.2 | 70 | 7.2 | 24.2 | 25.5 |
| Example 1 | 300 | 2.2 | 88 | 13.3 | 32.9 | 26.9 |
| | 100 | 1.2 | 6 | 1.5 | 16.8 | 38.4 |
| | Σ400 | 3.4 | 94 | 9.1 | 27.1 | 31.0 |

As can be seen from Table 1, the recovery of $WO_3$ may be considerably increased by the combination of the anion-active surfactant with the terminally blocked polyethylene glycol ether of Example 1 with a 40% lower collector dosage, selectivity also being more favorable. The collector mixture according to the invention also has distinct advantages with respect to selectivity and recovery over the mixture of alkyl sulfosuccinamide and fatty alcohol alkoxylate of Comparison Example 2.

Example 2

The flotation batch used was the same as in Example 1. The collector used contained the alkyl sulfosuccinamide of Example 1 as the anion-active component and an n-butylether based on an adduct of 5 moles ethylene oxide with 1 mole of a fatty alcohol mixture having a chain length of from 12 to 18 carbon atoms in a weight ratio of 2:1.

The flotation tests were carried out at room temperature in a modified Hallimond tube (microflotation cell) according to B. Dobias, Colloid & Polymer Science, 259 (1981), pages 115 to 116. Each test was carried out with 2 g of ore. Distilled water was used to prepare the pulp. The conditioning time was 15 minutes in each test. During flotation, an air stream was passed through the pulp at a rate of 4 ml/minute. In every test, the flotation time was 2 minutes.

The results obtained are shown in Table 2.

Example 3

The flotation batch used was the same as in Example 1. The collector mixture used contained the alkyl sulfosuccinamide of Example 1 as the anion-active component and an alkyl polyethylene glycol n-butyl-ether based on an adduct of 10 moles ethylene oxide with 1 mole of a fatty alcohol mixture having a chain length of from 12 to 18 in a weight ratio of 2:1. The flotation was carried out under the same conditions as in Example 2.

The flotation results are shown in Table 2.

Comparison Example 3

The flotation batch was the same as in Example 1. The collector mixture contained the alkyl sulfosuccinamide of Example 1 as the anion-active component and an adduct of 2 moles ethylene oxide and 4 moles propylene oxide with 1 mole of a fatty alcohol mixture having a chain length of from 12 to 18 carbon atoms in a weight ratio of 2:1. The flotation was carried out under the same conditions as in Example 2.

The results of the flotation test are shown in Table 2.

TABLE 2

| Example | Total dosage (g/t) | Flotation of scheelite: Recovery Total | Recovery $WO_3$ (%) | Concentrate content (%) $WO_3$ | CaO | $SiO_2$ |
|---|---|---|---|---|---|---|
| Comparison Example 3 | 500 | 6.6 | 57 | 2.8 | 15.7 | 44.9 |
| Example 2 | 500 | 7.7 | 71 | 3.0 | 15.1 | 42.5 |
| Example 3 | 300 | 5.5 | 53 | 3.2 | 13.6 | 47.0 |

The test results in Table 2 show that mixtures with fatty alcohol polyethylene glycol n-butylethers of different degrees of ethoxylation are superior with respect to flotation results compared to a corresponding collector mixture with a non-terminally blocked fatty alcohol polyalkoxylate as the nonionic component.

Example 4

The flotation batch used consisted of the tailings from an iron ore dressing plant which had the following chemical composition with respect to the principal constituents:

11.6% $P_2O_5$
34.9% $SiO_2$
13.0% $Fe_2O_3$
18.9% MgO

The flotation batch had the following particle size distribution:

| | |
|---|---|
| <25 μm | 5.7% |
| 25–100 μm | 15.0% |
| 200–500 μm | 69.8% |
| 500–1000 μm | 8.7% |
| >1000 μm | 0.8% |

The $Na/NH_4$ salt of a monoalkyl sulfosuccinate whose alkyl radical was derived from a technical oleyl/cetyl alcohol was used as the anion-active collector component. An alkyl polyethylene glycol n-butylether based on an adduct of 7 moles ethylene oxide with 1 mole of a fatty alcohol mixture having a chain length of from 12 to 18 carbon atoms was used as the nonionic surfactant. The ratio of the $Na/NH_4$ salt to the terminally blocked alkyl polyethylene glycol n-butylether was 65% to 35%.

The flotation tests were carried out at room temperature in a 1-liter laboratory flotation cell (Denver Equipment model D-1). Tapwater having a hardness of 16° Gh was used to prepare the pulp.

The pulp density was 500 g/l; the pH value was adjusted to 9.5 with sodium hydroxide before addition of the collector. After rougher flotation (for 6 minutes), the concentrate was purified twice. Flotation was carried out at 1200 l/minute in every stage. The flotation results are shown in Table 3 below.

Comparison Example 4

The flotation batch used was the same as in Example 4. The collector used was the $Na/NH_4$ salt of the monoalkyl sulfosuccinate of Example 4. The flotation was carried out under the same conditions as in Example 4. The results are shown in Table 3 below.

Comparison Example 5

The flotation batch used was the same as in Example 4. The collector mixture used contained the $Na/NH_4$ salt of the monoalkyl sulfosuccinate of Example 4 and an adduct of 2 moles ethylene oxide and 4 moles of propylene oxide with 1 mole of a fatty alcohol mixture having a chain length of from 12 to 18 carbon atoms. The collector mixture consisted of 65% of the anion-active surfactant and 35% of the fatty alcohol ethoxylate. The flotation was carried out under the same conditions as in Example 4. The results are shown in Table 3 below.

TABLE 3

| g/t | Example | Flotation of apatite: Flotation stage | Total recovery (%) | Valuable mineral recovery (%) | Content (%) $P_2O_5$ |
|---|---|---|---|---|---|
| 280 | Comparison Example 4 | rt | 72.6 | 10 | 1.7 |
| | | ct | 5.0 | 11 | 26.3 |
| | | conc. | 22.4 | 79 | 42.3 |
| | | batch | 100.0 | 100 | 12.0 |
| 200 | Example 4 | rt | 64.3 | 2 | 0.1 |
| | | ct | 6.5 | 2 | 6.1 |
| | | conc. | 29.2 | 96 | 40.0 |
| | | batch | 100.0 | 100 | 12.1 |
| 200 | Comparison Example 5 | rt | 76.3 | 27 | 4.2 |
| | | ct | 5.2 | 7 | 15.7 |
| | | conc. | 18.5 | 66 | 41.7 |
| | | batch | 100.0 | 100 | 11.7 |

rt = tailings of rougher flotation
ct = tailings of purifying flotation (total)
conc. = concentrate The flotation tests summarized in Table 3 clearly show that the collector combination according to Example 4 enables the collector dosage to be reduced by about 30% for an increased recovery of valuable material. A corresponding collector mixture according to Comparison Example 5 gives a much lower recovery of apatite.

Example 5

The flotation batch was a baryta ore of high sludge content which had the following chemical composition with regard to the principal constituents:

39% $BaSO_4$
6.5% $Fe_2O_3$
41.8% $SiO_2$

The flotation batch had the following particle size distribution:

| | |
|---|---|
| <25 μm | 87.2% |
| 25–40 μm | 10.7% |

-continued

| | |
|---|---|
| >40 μm | 2.1% |

A sodium salt of an alkyl ether sulfate based on an adduct of 3 moles ethylene oxide with a saturated fatty alcohol mixture having a chain length of from 12 to 18 carbon atoms was used as the anion-active component while an alkyl polyethylene glycol n-butyl ether based on an adduct of 7 moles ethylene oxide with a fatty alcohol mixture having a chain length of from 12 to 18 carbon atoms in a weight ratio of 9:1 was used as the terminally blocked nonionic surfactant of the invention.

The tests were carried out in a Denver model D-1 laboratory flotation cell. Flotation was carried out at a pulp density of 500 g/l in tapwater having a hardness of 16° Gh and at a pH value of 9.5 adjusted by the addition of waterglass. The waterglass dosage was 3000 g/t. After rougher flotation (for 6 minutes), the concentrate was purified twice. Flotation was carried out at 1200 l/minute in every stage. The results obtained are shown in Table 4.

Comparison Example 6

The flotation batch used was the same as in Example 5. The alkyl ether sulfate described in Example 5 was used as collector. The flotation was carried out under the same conditions as in Example 5. The results of the flotation test are shown in Table 4.

Comparison Example 7

The flotation batch was the same as in Example 5. The collector used was a commercial collector for the flotation of baryta based on petroleum sulfonate. The flotation was carried out under the same conditions as in Example 5. The results of the flotation test are shown in Table 4.

TABLE 4

| | | Flotation of baryta | | | |
|---|---|---|---|---|---|
| g/t | Example | Flotation stage | Total recovery (%) | Valuable mineral recovery (%) | Content (%) $P_2O_5$ |
| 200 | Example 5 | rt | 54.8 | 1 | 0.6 |
| | | ct | 12.9 | 2 | 4.8 |
| | | conc. | 32.3 | 97 | 94.9 |
| | | batch | 100.0 | 100 | 31.6 |
| 240 | Comparison Example 6 | rt | 58.2 | 1 | 0.4 |
| | | ct | 11.2 | 4 | 12.1 |
| | | conc. | 30.6 | 95 | 94.6 |
| | | batch | 100.0 | 100 | 30.5 |
| 600 | Comparison Example 7 | rt | 57.2 | 3 | 1.7 |
| | | ct | 24.6 | 41 | 51.6 |
| | | conc. | 18.2 | 56 | 96.0 |
| | | batch | 100.0 | 100 | 31.2 |

rt = tailings of rougher flotation
ct = tailings of purifying flotation (total)
conc. = concentrate The collector combination according to Example 5 enables the collector dosage to be reduced by 20% (without any losses in the recovery of baryta) compared with the alkyl ether sulfate used alone.

By comparison, the commercial petroleum sulfonate collector gives only a low recovery of baryta despite a considerably higher collector consumption.

Example 6

The flotation batch was a fluorite ore which had the following chemical composition with regard to the principal constituents:

| | |
|---|---|
| $CaF_2$ | 70% |
| $SiO_2$ | 12% |
| $CaCO_3$ | 10% |

The flotation batch had the following particle size distribution:

| | |
|---|---|
| <25 μm | 45.2% |
| 25–63 μm | 29.9% |
| 63–100 μm | 25.0% |
| >100 μm | 0.9% |

The collector composition in accordance with the invention contained technical grade oleic acid as the anion-active component. The nonionic component consisted of a fatty alcohol polyethylene glycol n-butyl ether based on an adduct of 5 moles ethylene oxide with one mole of a fatty alcohol mixture having a chain length of from 12 to 18 carbon atoms. The weight ratio of the anion-active component to the nonionic component was 7:3. The total collector dosage was 300 g/t.

The flotation tests were carried out in a laboratory flotation machine (Denver Equipment model D-1; 1-liter cell). The pulp density was 500 g/l in the rougher flotation and 300 g/l in the purifying flotation.

Quebracho was used as depressor, its total dosage amounting to 1500 g/t administered in three equal parts (500 g/t each) in the 3 stages of the purifying flotation.

The pulp temperature was 30° C. in all stages of the flotation. The pH of the pulp was within the range of 8 to 8.5. The conditioning time of depressor and collector was 5 minutes in each case. The conditioning was carried out at a stirring speed of 1400 r.p.m. Flotation was carried out at 1200 r.p.m. The flotation time was 6 minutes.

The flotation results are shown in Table 5.

Comparison Example 8

The flotation batch used was the same as in Example 6. The technical grade oleic acid of Example 6 alone was used as a collector, its total dosage amounting to 650 g/t. Flotation was carried out under the conditions described in Example 6. The results obtained are shown in Table 5.

TABLE 5

| Example | Flotation of fluorite: Total dosage (g/t) | $CaF_2$ Recovery (%) | Concentrate content $CaF_2$ (%) |
|---|---|---|---|
| Example 6 | 300 | 88 | 93.3 |
| Comparison Example 8 | 650 | 89 | 92.3 |

The test results in Table 5 show that in using the collector combination in accordance with the invention the collector dosage may be considerably reduced without a decrease in the recovery of the valuable mineral or in the concentrate content.

Example 7

The flotation batch consisted of a baryta ore which had the following chemical composition with regard to the principal constituents:

| | |
|---|---|
| $BaSO_4$ | 65% |
| Silicates | 20% |
| Iron ores | 10% |

The particle size distribution of the flotation batch was such that 100% were smaller than 75 μm.

The collector mixture in accordance with the invention contained, as the anion-active component, a sodium alkyl sulfate whose alkyl residue was derived from a fatty acid mixture consisting essentially of $C_{16}$–$C_{18}$ fatty alcohols. The nonionic component consisted of a fatty alcohol polyethylene glycol n-butyl ether based on an adduct of 5 moles ethylene oxide with one mole of a fatty alcohol mixture having a chain length of from 12 to 18 carbon atoms. The weight ratio of the anion-active component to the nonionic component was 6:4. The total collector dosage was 350 g/t.

The flotation tests were carried out in a laboratory flotation machine (Denver Equipment model D-1; 1-liter cell). The pulp density was 500 g/l.

Waterglass was used as a depressor in an amount of 1000 g/t. The pulp had a pH of 9 which resulted from the addition of waterglass. Flotation was carried out at room temperature with a rougher and a purifying stage, i.e. in two stages. The conditioning time of depressor and collector was 5 minutes each. The flotation time was 6 minutes. Conditioning and flotation were carried out at a stirring speed of 1200 r.p.m.

The results obtained are shown in Table 6.

Comparison Example 9

The flotation batch used was the same as in Example 7. The sodium alkyl sulfate of Example 7 alone was used as a collector, its total dosage being 450 g/t. For the rest the flotation of the baryta ore was carried out under the same conditions as the ones described in Example 7. The test results obtained are shown in Table 6.

TABLE 6

| Example | Flotation of baryta: Total dosage (g/t) | $BaSO_4$ Recovery (%) | Concentrate content $BaSO_4$ (%) |
|---|---|---|---|
| Example 7 | 350 | 98 | 91.6 |
| Comparison Example 9 | 450 | 97 | 91.3 |

The test results in Table 6 show that in using the collector mixture in accordance with the invention the same $BaSO_4$ recovery and the same $BaSO_4$ content in the concentrate may be achieved with a considerably reduced collector dosage as compared with the conventional sodium alkyl sulfate collector.

Example 8

The flotation batch was an apatite ore which had the following composition with regard to the principal constituents:

| | |
|---|---|
| Magnetite | 39% |
| apatite | 18% |
| carbonate | 11% |
| phlogopite | 14% |
| olivine | 9% |

The particle size distribution of the flotation batch was as follows:

| | |
|---|---|
| <25 μm | 18% |
| 25–100 μm | 34% |
| 100–200 μm | 43% |
| >200 μm | 5% |

The collector composition in accordance with the invention contained an acyl lactylate based on technical grade oleic acid as the anion-active component. The nonionic component consisted of an adduct of 5 moles ethylene oxide with one mole of a fatty alcohol mixture having a chain length of from 12 to 18 carbon atoms. The weight ratio of the anion-active component to the nonionic component was 7:3. The total collector dosage was 730 g/t.

The flotation tests were carried out in a laboratory flotation machine (Denver Equipment model D-1; 1.2-l cell) at 20° C. Hard water containing 945 ppm $Ca^{2+}$ and 1700 ppm $Mg^{2+}$ was used to prepare the pulp. After the ore had been suspended in the flotation cell the magnetite was removed with a hand magnet, washed with water and the wash water returned to the cell. The pulp density was 500 g/l. Waterglass was used as depressor in quantities of 2000 g/t. The pH of the pulp was adjusted to 11. Flotation was carried out at a rotational speed of the mixer of 1500 r.p.m. The flotation time was 6 minutes. After rougher flotation the concentrate was twice subjected to purifying flotation.

The results obtained are shown in Table 7.

Comparison Example 10

The flotation batch was the same as in Example 8. The acyl lactylate of Example 8 alone was used as a collector, its total dosage being 900 g/t. For the rest the flotation was carried out under the same conditions as Example 8. The results obtained are shown in Table 7.

TABLE 7

| Example | Flotation of apatite: Total dosage (g/t) | $P_2O_5$ Recovery (%) | Concentrate content $P_2O_5$ (%) |
|---|---|---|---|
| Example 8 | 730 | 80 | 22.3 |
| Comparison Example 10 | 900 | 83 | 17.6 |

The test results in Table 7 show that the collector combination according to Example 8 enables the collector dosage to be considerably reduced—in comparison with the dosage of the conventional collector of comparison Example 8—without decrease of the $P_2O_5$ recovery, while resulting in an increase on $P_2O_5$ content in the flotation product.

We claim:

1. In a process for the froth flotation of a mineral-containing non-sulfidic ore using an anion-active surfactant as collector for the mineral, the improvement comprising the use therein of at least one alkyl or alkenyl polyethylene glycol ether which is terminally blocked by a hydrophobic radical as a co-collector for the mineral, wherein the at least one alkyl or alkenyl polyethylene glycol ether has the formula:

$$R^1—O—(CH_2CH_2O)_n—R^2 \quad (I)$$

wherein $R^1$ is a straight-chain or branched alkyl or alkenyl radical having 8 to 22 carbon atoms, $R^2$ is a benzyl radical or a straight-chain or branched $C_1$–$C_8$ alkyl radical, and n is a number of from 2 to 15.

2. The process of claim 1 wherein $R^1$ in formula I is an alkyl or alkenyl radical having 12 to 18 carbon atoms.

3. The process of claim 1 wherein $R^2$ in formula I is an n-butyl radical.

4. The process of claim 1 wherein in formula I $R^1$ is an alkyl or alkenyl radical having 12 to 18 carbon atoms, and $R^2$ is an n-butyl radical.

5. The process of claim 1 wherein the at least one anion-active surfactant is selected from the group consisting of fatty acids, alkyl sulfates, alkyl ether sulfates, alkyl sulfosuccinates, alkyl sulfosuccinamides, alkyl benzene sulfonates, alkyl sulfonates, petroleum sulfonates, acyl lactylates, alkyl phosphates, and alkyl ether phosphates.

6. The process of claim 1 wherein the molar ratio of terminally blocked alkyl or alkenyl polyethylene glycol ether to anion-active surfactant is form about 1:20 to about 3:1.

7. The process of claim 6 wherein said ratio is from about 1:10 to about 1:1.

8. The process of claim 6 wherein the terminally blocked alkyl or alkenyl polyethylene glycol ether and the anion-active surfactant are used in a total quantity of from about 50 to about 2000 g/t of ore.

9. The process of claim 8 wherein said total quantity is from about 100 to about 1500 g/t of ore.

10. A process for the separation of a mineral-containing non-sulfidic ore by froth flotation comprising the steps of:

(a) mixing the non-sulfidic ore in ground form with water to form a suspension;

(b) introducing air into the suspension in the presence from about 50 to about 2000 g/t of ore of a collector mixture containing (i) at least one alkyl or alkenyl polyethylene glycol ether which is terminally blocked by a hydrophobic radical wherein the at least one alkyl or alkenyl polyethylene glycol ether has the formula:

$$R^1—O—(CH_2CH_2O)_n—R^2 \quad (I)$$

wherein $R^1$ is a straight-chain or branched alkyl or alkenyl radical having 8 to 22 carbon atoms, $R^2$ is a benzyl radical or a straight-chain or branched $C_1$–$C_8$ alkyl radical, and n is a number of from 2 to 15, and (ii) at least one anion-active surfactant, wherein the weight ratio of component (i) to component (ii) is from about 1:20 to about 3:1 to form a froth containing the mineral; and (c) removing the mineral-containing froth.

11. The process of claim 10 wherein the ore is either scheelite, apatite, baryta, or iron ore.

12. The process of claim 10 wherein $R^1$ in formula I is an alkyl or alkenyl radical having 12 to 18 carbon atoms.

13. The process of claim 10 wherein $R^2$ in formula I is an n-butyl radical.

14. The process of claim 10 wherein in formula I $R^1$ is is an alkyl or alkenyl radical having 12 to 18 carbon atoms, and $R^2$ is an n-butyl radical.

15. The process of claim 10 wherein in stpe (b) (ii) the at least one anion-active surfactant is selected from the group consisting of fatty acids, alkyl sulfates, alkyl ether sulfates, alkyl sulfosuccinates, alkyl sulfosuccinamides, alkyl benzene sulfonates, alkyl sulfonates, petroleum sulfonates, acyl lactylates, alkyl phosphates, and alkyl ether phosphates.

16. The process of claim 10 wherein said ratio is from about 1:10 to about 1:1.

* * * * *